US012188483B2

(12) United States Patent
Lin et al.

(10) Patent No.: US 12,188,483 B2
(45) Date of Patent: Jan. 7, 2025

(54) CENTRIFUGAL FAN

(71) Applicant: ASUSTEK COMPUTER INC., Taipei (TW)

(72) Inventors: Hsin Chen Lin, Taipei (TW); Ing-Jer Chiou, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 18/117,013

(22) Filed: Mar. 3, 2023

(65) Prior Publication Data

US 2024/0035486 A1 Feb. 1, 2024

(30) Foreign Application Priority Data

Aug. 1, 2022 (TW) ..... 111208239

(51) Int. Cl.
*F04D 29/42* (2006.01)
*F04D 17/16* (2006.01)
*F04D 29/28* (2006.01)

(52) U.S. Cl.
CPC ..... *F04D 29/4226* (2013.01); *F04D 17/16* (2013.01); *F04D 29/281* (2013.01)

(58) Field of Classification Search
CPC . F04D 29/4226; F04D 29/424; F04D 29/4246
See application file for complete search history.

(56) References Cited

U.S. PATENT DOCUMENTS 9,322,413 B2 * 4/2016 Lin ..... F04D 29/4213
11,512,711 B2 * 11/2022 Sun ..... F04D 17/16

FOREIGN PATENT DOCUMENTS

CN 215170894 U 12/2021

* cited by examiner

*Primary Examiner* — Sabbir Hasan
(74) *Attorney, Agent, or Firm* — MUNCY, GEISSLER, OLDS & LOWE, P.C.

(57) ABSTRACT

The disclosure provides a centrifugal fan including a housing and a blade module. The housing includes a lower cover, a side wall, and an upper cover. Two ends of the side wall are respectively connected to the lower cover and the upper cover to define an internal space. The lower cover includes a plurality of lower air inlets. The blade module is arranged in the internal space, and includes a hub and a plurality of blades. The hub is rotatably arranged on the lower cover. The blades are arranged around the hub. The lower air inlets are located on the periphery of the hub, and each lower air inlet includes an outer edge relative to a rotational axis of the hub. At least one of two ends of at least one of the lower air inlets includes a protruding portion at a position corresponding to the outer edge.

11 Claims, 9 Drawing Sheets

CENTRIFUGAL FAN

CROSS-REFERENCE TO RELATED APPLICATION

This application claims the priority benefit of Taiwan application serial No. 111208239, filed on Aug. 1, 2022. The entirety of the above-mentioned patent application is hereby incorporated by reference herein and made a part of the specification.

BACKGROUND OF THE INVENTION

Field of the Invention

The disclosure relates to a fan, and in particular, to a centrifugal fan.

Description of the Related Art

With the improvement of the performance of notebook computers, requirements for heat dissipation also increase. To resolve the heat dissipation problem, centrifugal fans have been widely applied to notebook computers, to generate forced convection, thereby improving the heat dissipation efficiency.

FIG. 1 is a schematic exploded view of a conventional centrifugal fan 100. A housing 101 of the centrifugal fan 100 includes a lower cover 110, a side wall 120, and an upper cover 130. Both the lower cover 110 and the upper cover 130 include air inlets 112, 132. The side wall 120 is clamped between the lower cover 110 and the upper cover 130. The lower cover 110 includes, between the air inlets 112, a plurality of ribs 114 connected to a disc structure 116, to bear a hub 140. Blades 150 are connected to a periphery of the hub 140. The ribs 114 hinder inflowing airflows, resulting in easy formation of airflow noise or reduction of flow rates of the airflows.

To reduce impact of the ribs 114 on the inflowing airflows, a conventional method is to reduce the quantity of the ribs 114 or reduce the width of the ribs 114. However, the design methods all have the structural fragility defect, which is prone to cause rib fracture or structural vibration.

BRIEF SUMMARY OF THE INVENTION

The disclosure provides a centrifugal fan. The centrifugal fan includes a housing and a blade module. The housing includes a lower cover, a side wall, and an upper cover. Two ends of the side wall are respectively connected to the lower cover and the upper cover. The lower cover, the side wall, and the upper cover define an internal space. In addition, the lower cover includes a plurality of lower air inlets. The blade module is arranged in the internal space, and includes a hub and a plurality of blades. The hub is rotatably arranged on the lower cover. The blades are arranged around a periphery of the hub. The lower air inlets are located on the periphery of the hub, and each lower air inlet includes an outer edge relative to a rotational axis of the hub. At least one of two ends of at least one of the lower air inlets includes a protruding portion at a position corresponding to the outer edge.

In the centrifugal fan provided by the disclosure, the outer edge of the lower air inlet includes a protruding portion at a position corresponding to at least one of a front end or a tail end, to increase an opening area of a specific position, thereby reducing airflow noise and improving the operating efficiency of the centrifugal fan.

DETAILED DESCRIPTION OF THE EMBODIMENTS

More detailed descriptions of specific embodiments of the disclosure are provided below with reference to the schematic diagrams. The features and advantages of the disclosure are described more clearly according to the following description and claims. It should be noted that all of the drawings use very simplified forms and imprecise proportions, only being used for assisting in conveniently and clearly explaining the objective of the embodiments of the disclosure.

Figure 2:
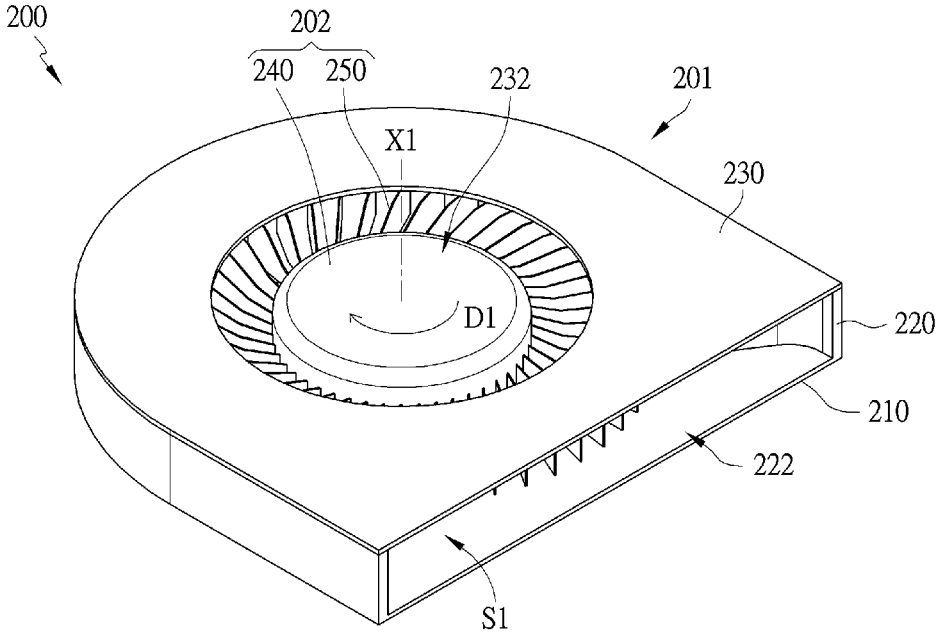
FIG. 2 is a three-dimensional view of a centrifugal fan according to an embodiment of the disclosure.
Figure 3:
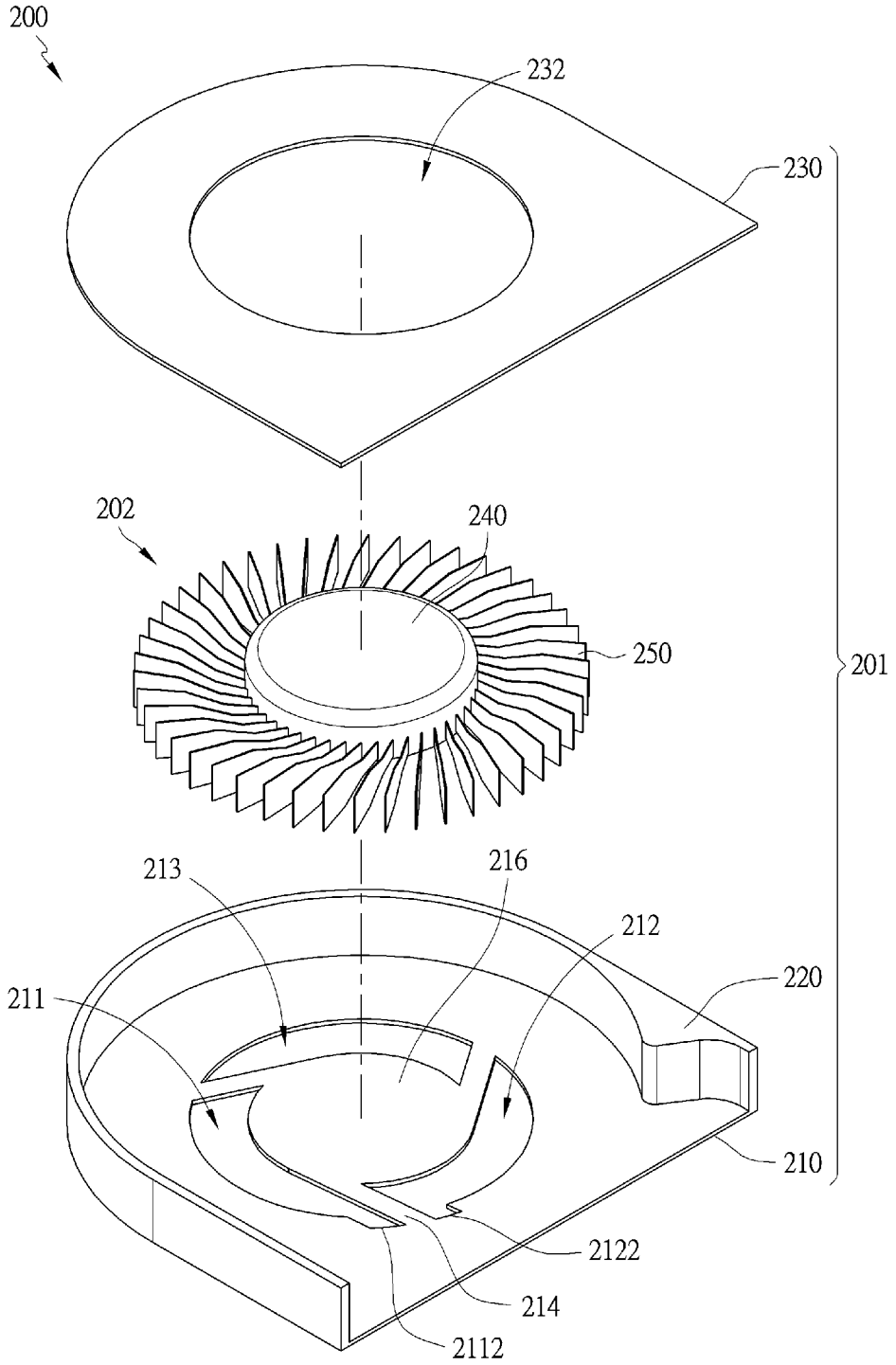
FIG. 3 is a schematic exploded view of the centrifugal fan in FIG. 2.

FIG. 2 is a three-dimensional view of a centrifugal fan 200 according to an embodiment of the disclosure. FIG. 3 is a schematic exploded view of the centrifugal fan 200 in FIG. 2.

As shown in the figure, the centrifugal fan 200 includes a housing 201 and a blade module 202. The housing 201 includes a lower cover 210, a side wall 220, and an upper cover 230. The side wall 220 is clamped between the lower cover 210 and the upper cover 230, to define an internal space 51. The lower cover 210 includes a plurality of lower air inlets 211, 212, 213. Three lower air inlets 211, 212, 213 are shown in the figure as an example. The upper cover 230 includes an upper air inlet 232. The side wall 220 includes an air outlet 222. The lower air inlets 211, 212, 213 of the lower cover 210 define a plurality of ribs 214 and a disc structure 216. Each rib 214 is located between neighboring lower air inlets 211, 212, 213, and is configured to connect to the disc structure 216.

The blade module 202 is arranged in the internal space 51, and includes a hub 240 and a plurality of blades 250. The hub 240 is rotatably arranged on the disc structure 216 on the lower cover 210. The blades 250 are arranged around a periphery of the hub 240. In an embodiment, a motor (not shown in the figure) is arranged in the hub 240, to drive the blade module 202 to rotate.

Figure 4:
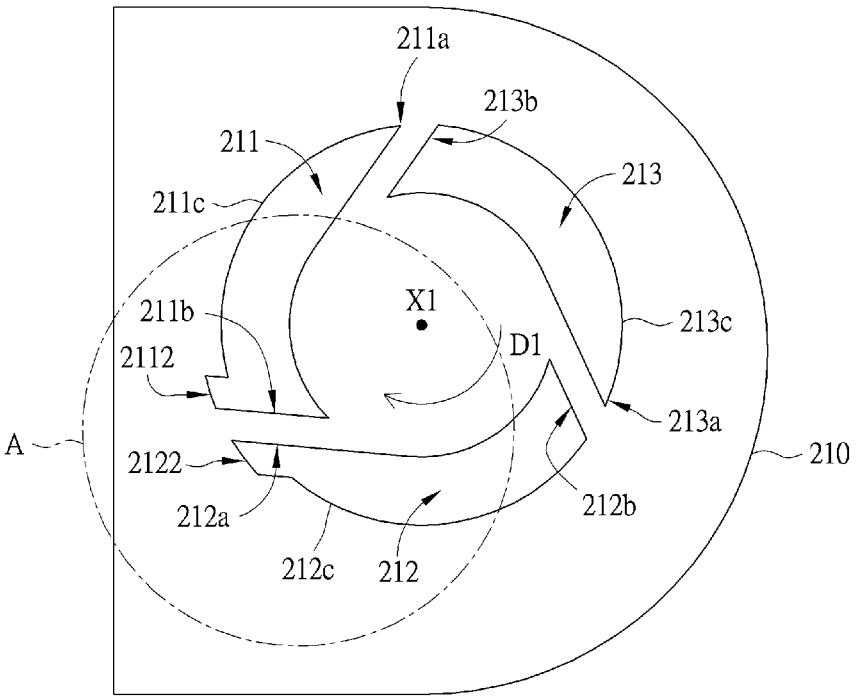
FIG. 4 is a schematic top view of a lower cover of the centrifugal fan in FIG. 2.

Reference is also made to FIG. 4. FIG. 4 is a schematic top view of a lower cover 210 of the centrifugal fan 200 in FIG. 2. The lower cover 210 includes a plurality of lower air inlets 211, 212, 213. The lower air inlets 211, 212, 213 are located on the periphery of the hub 240. Each lower air inlet 211, 212, 213 includes a front end 211*a*, 212*a*, 213*a* and a tail end 211*b*, 212*b*, 213*b* along a rotation direction D1 of the hub 240. In addition, each lower air inlet 211, 212, 213 includes an outer edge 211*c*, 212*c*, 213*c* relative to a rotational axis X1 of the hub 240.

At least one of two ends (that is, the front end 211*a*, 212*a*, 213*a* and the tail end 211*b*, 212*b*, 213*b*) of at least one of the lower air inlets 211, 212, 213 includes a protruding portion 2112, 2122 at a position corresponding to the outer edge 211*c*, 212*c*, 213*c*. For example, as shown in the figure, the tail end 211*b* of the lower air inlet 211 includes a protruding portion 2112 at a position corresponding to the outer edge 211*c*. The front end 211*a* of the lower air inlet 212 includes a protruding portion 2122 at a position corresponding to the outer edge 212*c*. The quantity and arrangement positions of the protruding portions 2112, 2122 are adjustable according to actual conditions (for example, the structure of the lower cover 210, the position of the air outlet 222, and the rotation speed of the blade module 202).

Figure 5:
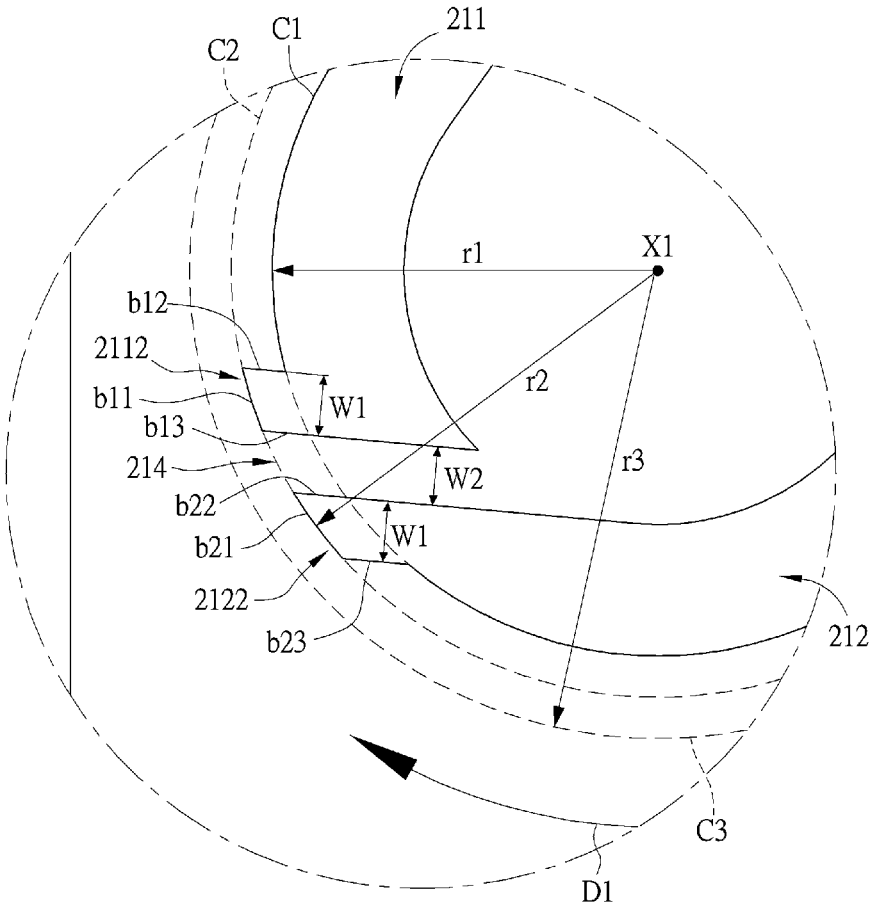
FIG. 5 enlarges display of a region A in FIG. 4.

Reference is also made to FIG. 5. FIG. 5 enlarges display of a region A in FIG. 4.

As shown in the figure, there is a rib 214 between two neighboring lower air inlets 211, 212. Each protruding portion 2112, 2122 is defined by a bottom edge b11, b21 and two side edges b12, b13, b22, b23. The bottom edge b11, b21 is formed by the outer edge 211*c*, 212*c* of the lower air inlet 211, 212 deviating outward by a specific distance d0. The distance d0 is a depth of the protruding portion 2112, 2122. The side edges b12, b13, b22, b23 are parallel to a direction of the rib 214.

The protruding portion 2112, 2122 has a first width w1. The rib 214 has a second width w2. The first width w1 is greater than half of the second width w2, but is less than two times the second width w2.

In an embodiment, as shown in the figure, the outer edges 211*c*, 212*c*, 213*c* of the lower air inlets 211, 212, 213 define a first circle C1. A center of the first circle C1 is located at the rotational axis X1. The bottom edges (that is, positions farthest from the rotational axis X1) of the protruding portions 2112, 2122 define a second circle C2 on an outer side of the first circle C1. A center of the second circle C2 is located at the rotational axis X1. The first circle C1 has a first radius r1. The second circle C2 has a second radius r2. A difference between the first radius r1 and the second radius r2 is greater than 5% of the first radius r1. In an embodiment, tips of blades (not shown in the figure) define a third circle C3. A center of the third circle C3 is located at the rotational axis X1. The third circle C3 has a third radius r3. The second radius r2 is less than the third radius r3.

The protruding portions 2112, 2122 in this embodiment have the same width, and the bottom edges of the protruding portions 2112, 2122 are both located in the second circle C2, but the disclosure is not limited thereto. In other embodiments, the protruding portions 2112, 2122 also have different widths, and the protruding portions 2112, 2122 also define different circles. That is, the protruding portions 2112, 2122 have different depths.

The improvement effects of the protruding portion 2112, 2122 of the disclosure on airflows are described below by according to rotation directions of blades 150, 250.

Figure 1:
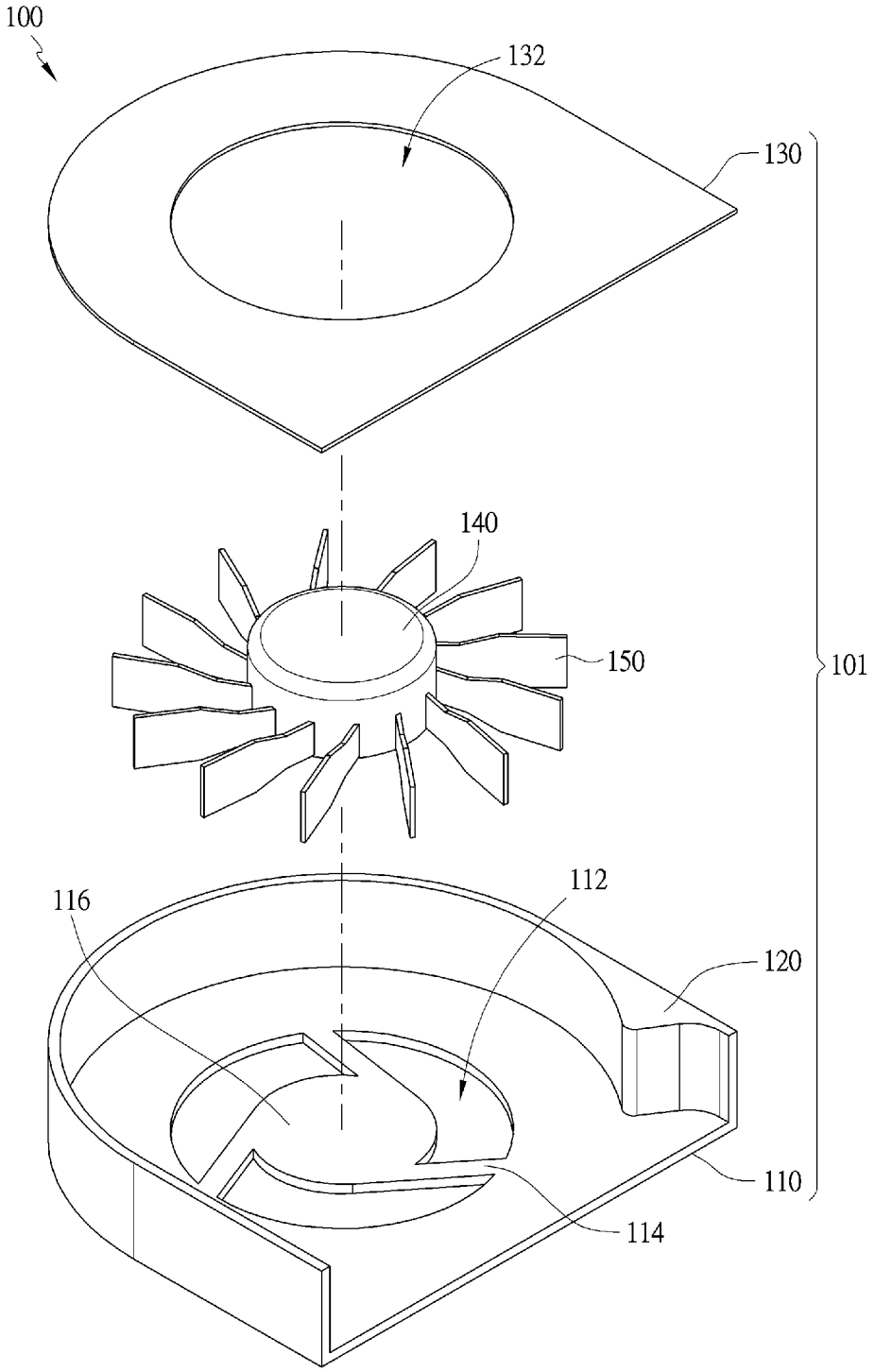
FIG. 1 is a schematic exploded view of a conventional centrifugal fan.

Reference is made to both FIG. 1 and FIG. 4. When the blades 150 of the conventional centrifugal fan 100 rotate close to the ribs 114, an air inlet area of the air inlets 112 directly below the blade 150 is gradually reduced. Because the air inlet area is gradually reduced, flow rates of airflows are increased, and at the same time, the airflow resistance becomes larger, which makes it difficult for the airflow to pass through the air inlets 112 and also generates relatively large airflow noise.

When the blades 150 rotate away from the ribs 114, the air inlet area of the air inlets 112 directly below the blade 150 is rapidly increased. Although the air inlet area is rapidly increased, a low-pressure space is formed due to the blockage of the ribs 114. When the blades 150 are away from the ribs 114, a large airflow suction is generated, resulting in high-rate flowing of airflows, which causes the airflow noise problem.

In contrast, at least one of the front end 211*a*, 212*a*, 213*a* and the tail end 211*b*, 212*b*, 213*b* of the lower air inlet 211, 212, 213 of the centrifugal fan 200 of the disclosure includes a protruding portion 2112, 2122 at a position corresponding to the outer edge 211*c*, 212*c*, 213*c* thereof. The protruding portions 2112, 2122 increase the air inlet area, alleviate the phenomenon of airflow acceleration caused by the gradual reduction of the air inlet area when the blades 250 rotate close to the ribs 214, and also help to increase the volume of the inflowing air. Secondly, the protruding portions 2112, 2122 increase the air inlet area, alleviate the airflow acceleration phenomenon caused by the blades 250 rotating away from the ribs 214, reduce airflow noise, and also help to increase the volume of the inflowing air.

Figure 6A:
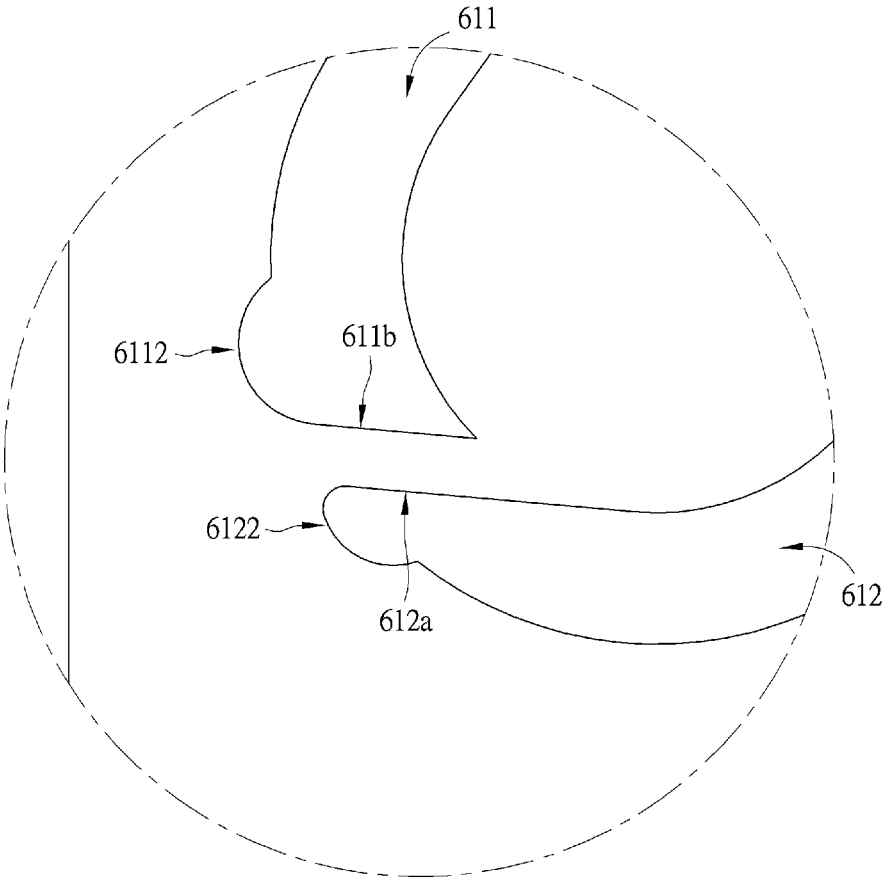
FIG. 6A is a schematic diagram of another embodiment of a protruding portion of a lower air inlet according to the disclosure.

FIG. 6A is a schematic diagram of another embodiment of a protruding portion 6112, 6122 of a lower air inlet 611, 612 according to the disclosure.

Compared with that the protruding portion 2112, 2122 shown in FIG. 5 has a roughly U-shaped contour, the protruding portion 6112, 6122 of this embodiment has an arc-shaped contour. In addition, a width of the protruding portion 6112 located at a tail end 611*b* of the lower air inlet 611 is greater than a width of the protruding portion 6122 located at a front end 612*a* of the lower air inlet 612.

Figure 6B:
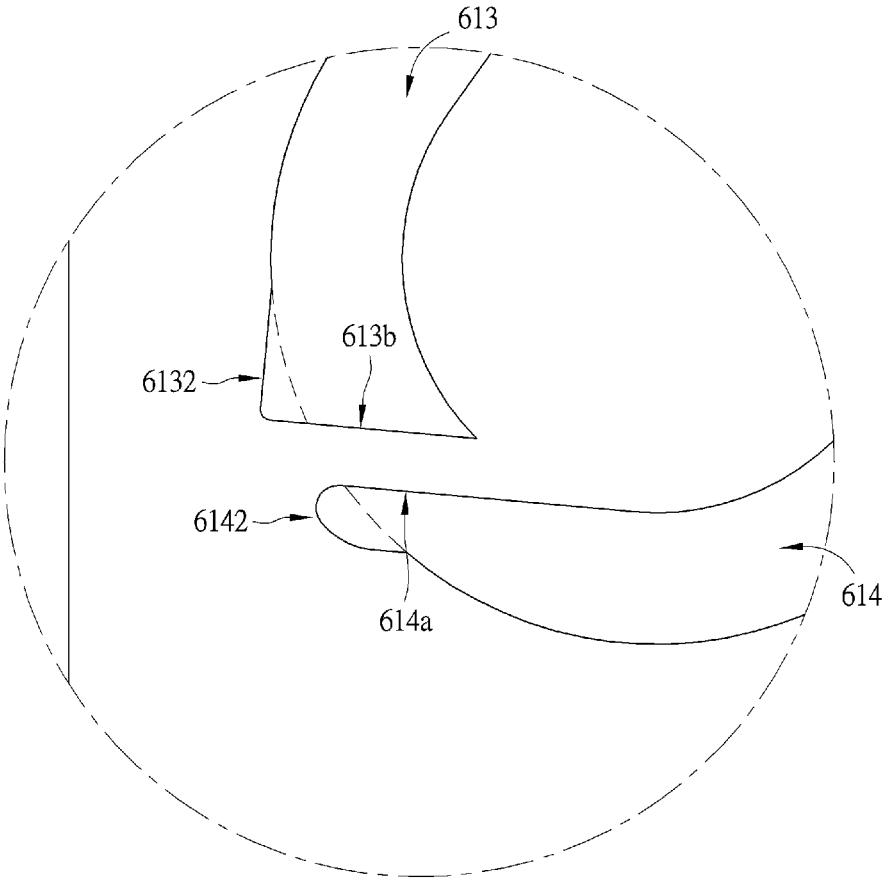
FIG. 6B is a schematic diagram of still another embodiment of a protruding portion of a lower air inlet according to the disclosure.

FIG. 6B is a schematic diagram of still another embodiment of a protruding portion 6132, 6142 of a lower air inlet 613, 614 according to the disclosure;

Compared with that the protruding portion 2112, 2122 shown in FIG. 5 has a roughly U-shaped contour, the protruding portion 6132 and the protruding portion 6142 of this embodiment have obviously different shape. In addition, the protruding portion 6132 located at a tail end 613*b* of the lower air inlet 613 has a V-shaped contour, and the protruding portion 6142 located at a front end 614*a* of the lower air inlet 614 has an arc-shaped contour.

Figure 7:
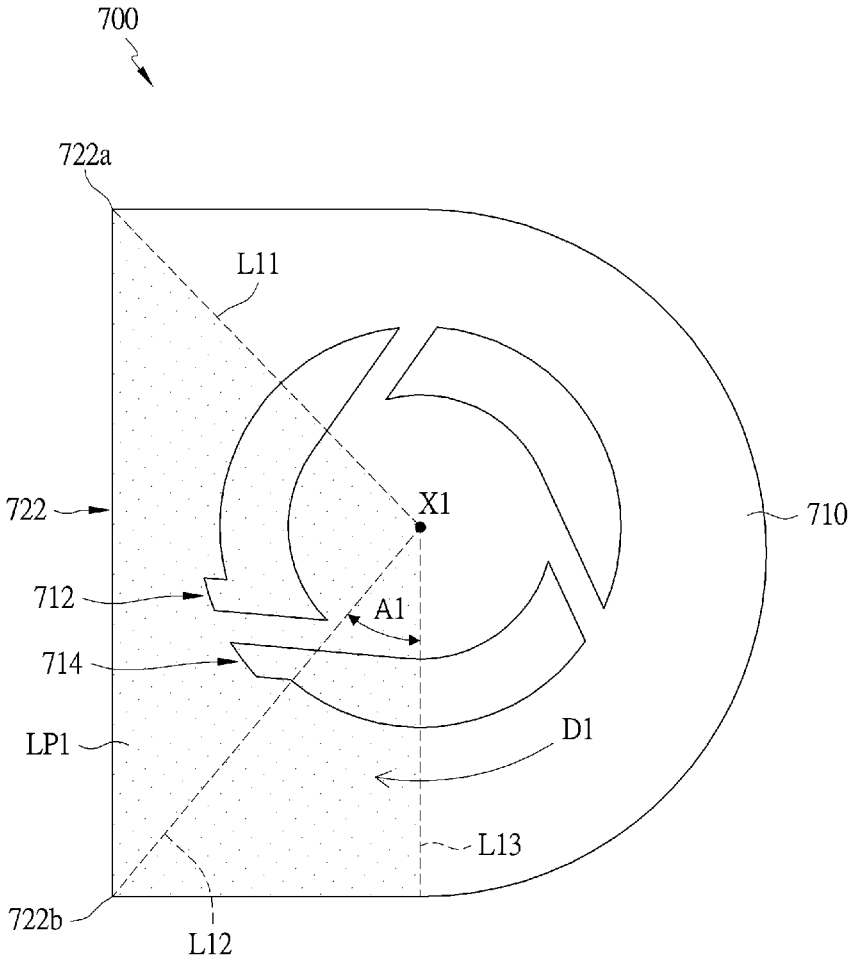
FIG. 7 shows a correspondence between a protruding portion of a lower air inlet and a position of an air outlet of a centrifugal fan according to an embodiment of the disclosure.

Reference is made to FIG. 7. FIG. 7 shows a correspondence between a protruding portion of a lower air inlet and a position of an air outlet of a centrifugal fan according to an embodiment of the disclosure.

In an embodiment, a centrifugal fan 700 includes an air outlet 722. The air outlet 722 includes a front side 722*a* and a rear side 722*b* with respect to a rotation direction D1 of a hub (not shown in the figure). The front side 722*a*, the rear side 722*b*, and the rotational axis X1 define a low-pressure region LP1.

In an embodiment, the front side 722*a* and the rotational axis X1 form a first boundary L11. The rear side 722*b* and the rotational axis X1 form a second boundary L12. The second boundary L12 rotates with the rotational axis X1 as a center by a preset angle A1 in an opposite direction of the rotation direction D1, to form a third boundary L13. The first boundary L11 and the third boundary L13 form the low-pressure region LP1. In an embodiment, the aforementioned preset angle A1 ranges from 20 to 60 degrees. The preset angle A1 is affected by factors such as the structure design of the centrifugal fan 700 and the rotation speed of the motor.

Protruding portions 712, 714 on a lower cover 710 of the centrifugal fan 700 of this embodiment are limited to the low-pressure region LP1.

When the centrifugal fan 700 operates, an internal space thereof has a relatively high airflow pressure in a region other than the low-pressure region LP1. A protruding portion formed in the region causes pressure loss, which affects the operating efficiency of the centrifugal fan 700. This embodiment limits arrangement positions of protruding portions 712, 714 to the low-pressure region LP1, which is beneficial to reducing airflow noise while improving the operating efficiency of the fan.

Figure 8:
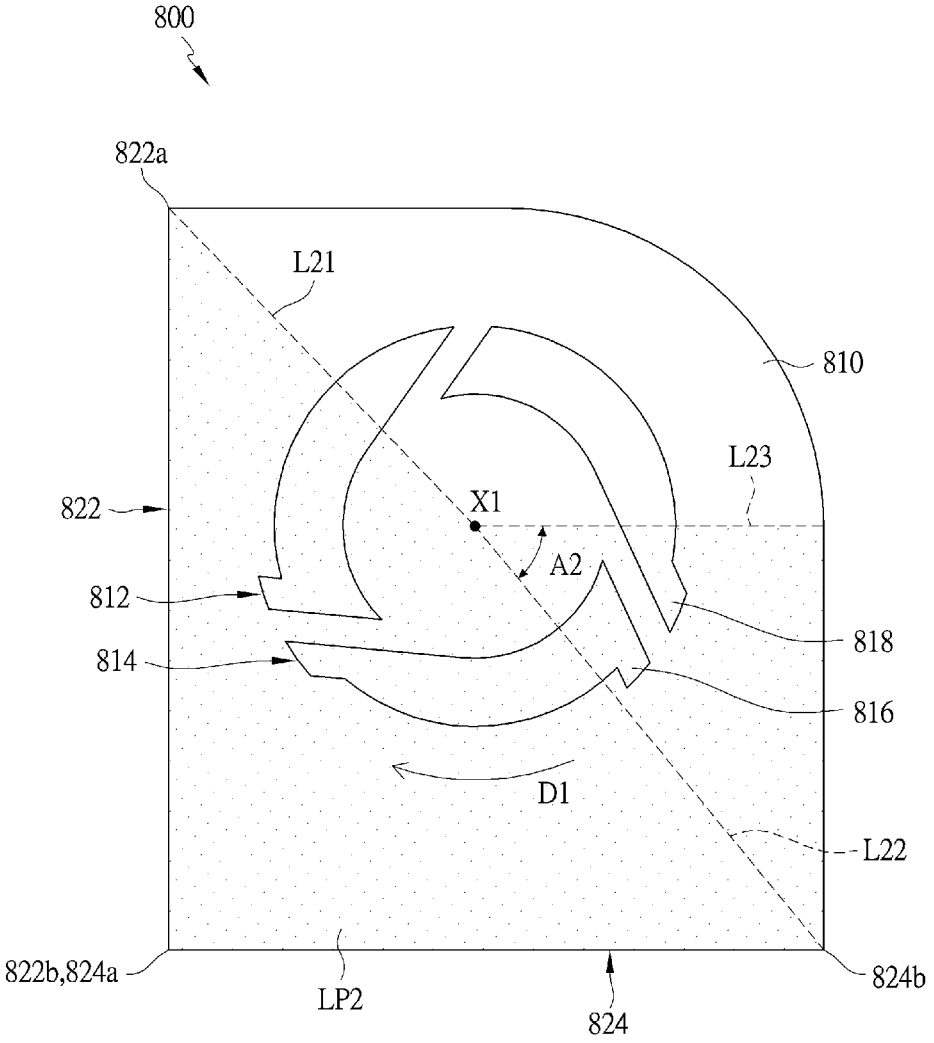
FIG. 8 shows a correspondence between a protruding portion of a lower air inlet and a position of an air outlet of a centrifugal fan according to another embodiment of the disclosure.

Reference is made to FIG. 8. FIG. 8 shows a correspondence between a protruding portion of a lower air inlet and a position of an air outlet of a centrifugal fan according to another embodiment of the disclosure.

Compared to that the centrifugal fan 700 in FIG. 7 includes only a single air outlet 722, a centrifugal fan 800 of this embodiment includes a first air outlet 822 and a second air outlet 824, to increase the air outlet volume.

As shown in the figure, an air outlet direction of the first air outlet 822 is perpendicular to that of the second air outlet 824. The first air outlet 822 includes a first front side 822*a* and a first rear side 822*b* relative to a rotation direction D1 of a hub (not shown in the figure). The second air outlet 824 includes a second front side 824*a* and a second rear side 824*b* relative to the rotation direction D1 of the hub (not shown in the figure). The first front side 822*a*, the second rear side 824*b*, and a rotational axis X1 define a low-pressure region LP2.

In an embodiment, the first front side 822*a* and the rotational axis X1 form a first boundary L21. The second rear side 824*b* and the rotational axis X1 form a second boundary L22. The second boundary L22 rotates with the rotational axis X1 as a center by a preset angle A2 in an opposite direction of the rotation direction D1, to form a third boundary L23. The first boundary L21 and the third boundary L23 form the low-pressure region LP2. In an embodiment, the aforementioned preset angle A2 ranges from 20 to 60 degrees. The preset angle A2 is affected by factors such as the structure design of the centrifugal fan 800 and the rotation speed of the motor.

Protruding portions 812, 814, 816, 818 of a lower cover 810 of the centrifugal fan 800 of this embodiment are limited to the low-pressure region LP2, which is beneficial to reducing airflow noise while improving the operating efficiency of the fan.

At least one of the front end 211*a*, 212*a*, 213*a* and the tail end 211*b*, 212*b*, 213*b* of the lower air inlet 211, 212, 213 of the centrifugal fan 200, 700, 800 of the disclosure includes a protruding portion 2112, 2122 at a position corresponding to the outer edge 211*c*, 212*c*, 213*c* thereof. The protruding portion 2112, 2122 increases an opening area of a specific position of the lower air inlet 211, 212, 213, thereby reducing airflow noise and improving the operating efficiency of the centrifugal fan.

The above are only exemplary embodiments of the disclosure and are not intended to limit the disclosure in any way. Any form of equivalent replacements or modifications to the technical means and technical content disclosed in the disclosure made by a person skilled in the art without departing from the scope of the technical means of the disclosure still fall within the content of the technical means of the disclosure and the protection scope of the disclosure.

What is claimed is:

1. A centrifugal fan, comprising:

a housing, comprising a lower cover, a side wall, and an upper cover, wherein two ends of the side wall are respectively connected to the lower cover and the upper cover, the lower cover, the side wall, and the upper cover define an internal space, and the lower cover comprises a plurality of lower air inlets; and a blade module, arranged in the internal space, and comprising:

a hub, rotatably arranged on the lower cover; and a plurality of blades, arranged around a periphery of the hub, wherein the lower air inlets are located on the periphery of the hub, and each lower air inlet comprises an outer edge relative to a rotational axis of the hub; and at least one of two ends of at least one of the lower air inlets comprises a protruding portion at a position corresponding to the outer edge;

wherein the outer edge define a first circle, the protruding portion define a second circle on an outer side of the first circle, the first circle has a first radius, the second circle has a second radius, and a difference between the first radius and the second radius is greater than 5% of the first radius;

wherein tips of the blades define a third circle, the third circle has a third radius, and the second radius is less than the third radius;

wherein the protruding portion has a first width, a rib between two neighboring lower air inlets has a second width, and the first width is greater than half of the second width, but is less than two times the second width;

wherein two of the protruding portions are located beside the rib.

2. The centrifugal fan according to claim 1, wherein the upper cover comprises an upper air inlet.

3. The centrifugal fan according to claim 1, wherein the side wall comprises two air outlets, and air outlet directions of the two air outlets are perpendicular to each other.

4. The centrifugal fan according to claim 1, wherein the protruding portion has a first width, a rib between neighboring two of the plurality of lower air inlets has a second width, and the first width is greater than half of the second width, but is less than two times the second width.

5. The centrifugal fan according to claim 1, wherein the side wall comprises an air outlet, the air outlet comprises a front side and a rear side with respect to a rotation direction of the hub, the front side, the rear side, and the rotational axis define a low-pressure region, and the protruding portion is located in the low-pressure region.

6. The centrifugal fan according to claim 5, wherein the front side and the rotational axis form a first boundary, the rear side and the rotational axis form a second boundary, the second boundary rotates with the rotational axis as a center by a preset angle in an opposite direction of the rotation direction to form a third boundary, and the first boundary and the third boundary form the low-pressure region.

7. The centrifugal fan according to claim 6, wherein the preset angle ranges from 20 to 60 degrees.

8. The centrifugal fan according to claim 1, wherein the side wall comprises a first air outlet and a second air outlet, an air outlet direction of the first air outlet is perpendicular to that of the second air outlet, the first air outlet comprises a first front side and a first rear side with respect to a rotation direction of the hub, the second air outlet comprises a second front side and a second rear side with respect to the rotation direction of the hub, the first front side, the second rear side, and the rotational axis define a low-pressure region, and the protruding portion is located in the low-pressure region.

9. The centrifugal fan according to claim 8, wherein the first front side and the rotational axis form a first boundary, the second rear side and the rotational axis form a second boundary, the second boundary rotates with the rotational axis as a center by a preset angle in an opposite direction of the rotation direction to form a third boundary, and the first boundary and the third boundary form the low-pressure region.

10. The centrifugal fan according to claim 9, wherein the preset angle ranges from 20 to 60 degrees.

11. A centrifugal fan, comprising:

a housing, comprising a lower cover, a side wall, and an upper cover, wherein two ends of the side wall are respectively connected to the lower cover and the upper cover, the lower cover, the side wall, and the upper cover define an internal space, and the lower cover comprises a plurality of lower air inlets; and a blade module, arranged in the internal space, and comprising:

a hub, rotatably arranged on the lower cover; and a plurality of blades, arranged around a periphery of the hub, wherein the lower air inlets are located on the periphery of the hub, and each lower air inlet comprises an outer edge relative to a rotational axis of the hub; and at least one of two ends of at least one of the lower air inlets comprises a protruding portion at a position corresponding to the outer edge;

wherein the outer edge define a first circle, the protruding portion define a second circle on an outer side of the first circle, the first circle has a first radius, the second circle has a second radius, and a difference between the first radius and the second radius is greater than 5% of the first radius;

wherein tips of the blades define a third circle, the third circle has a third radius, and the second radius is less than the third radius;

wherein the side wall comprises an air outlet, the air outlet comprises a front side and a rear side with respect to a rotation direction of the hub, the front side, the rear side, and the rotational axis define a low-pressure region, and the protruding portion is located in the low-pressure region;

wherein the front side and the rotational axis form a first boundary, the rear side and the rotational axis form a second boundary, the second boundary rotates with the rotational axis as a center by a preset angle in an opposite direction of the rotation direction to form a third boundary, and the first boundary and the third boundary form the low-pressure region;

wherein the preset angle ranges from 20 to 60 degrees;

wherein at least a part of the protruding portion is located in a part of the low-pressure region between the second boundary and the third boundary.

* * * * *